US005394139A

United States Patent [19]

Dards

[11] Patent Number: 5,394,139

[45] Date of Patent: Feb. 28, 1995

[54] SMOKE SCREEN INTRUDER DETERRENT SYSTEM

[76] Inventor: Paul A. Dards, 10 Cochrane Close, Crownhill, Milton Keynes MK8 0AJ, United Kingdom

[21] Appl. No.: 235,123

[22] Filed: Apr. 28, 1994

Related U.S. Application Data

[63] Continuation of Ser. No. 983,801, Nov. 30, 1992, abandoned.

[30] Foreign Application Priority Data

Sep. 12, 1992 [GB] United Kingdom ..... 92 19365

[51] Int. Cl.[6] ..... G08B 15/02

[52] U.S. Cl. ..... 340/541; 102/334; 340/691

[58] Field of Search ..... 340/691, 541; 102/334

[56] References Cited

U.S. PATENT DOCUMENTS 3,432,439 8/1969 Dickman ..... 102/334
3,772,687 11/1973 Scott ..... 340/541
4,531,114 7/1985 Topol et al. ..... 340/691
4,998,479 3/1991 Perham et al. ..... 102/334
5,182,541 1/1993 Bajorek et al. ..... 340/691

FOREIGN PATENT DOCUMENTS 2247094 2/1992 United Kingdom .

OTHER PUBLICATIONS

JEM Smoke Machine Co. Ltd., The Catalogue 90/91.

*Primary Examiner*—Glen Swann
*Attorney, Agent, or Firm*—Galgano & Burke

[57] ABSTRACT

An intruder deterrent system of the type which generates a smoke screen and which includes an intruder detector, a smoke screen generator operatively linked to the intruder detector means and the smoke screen generator to activate the smoke screen generator when the intruder detector is triggered; and smoke screen density regulator having a smoke screen density sensor to sense the density of the smoke screen and a controller responsive to the sensed density to adjust the output of the smoke screen generator means to maintain the smoke screen density at a desired level.

6 Claims, 1 Drawing Sheet

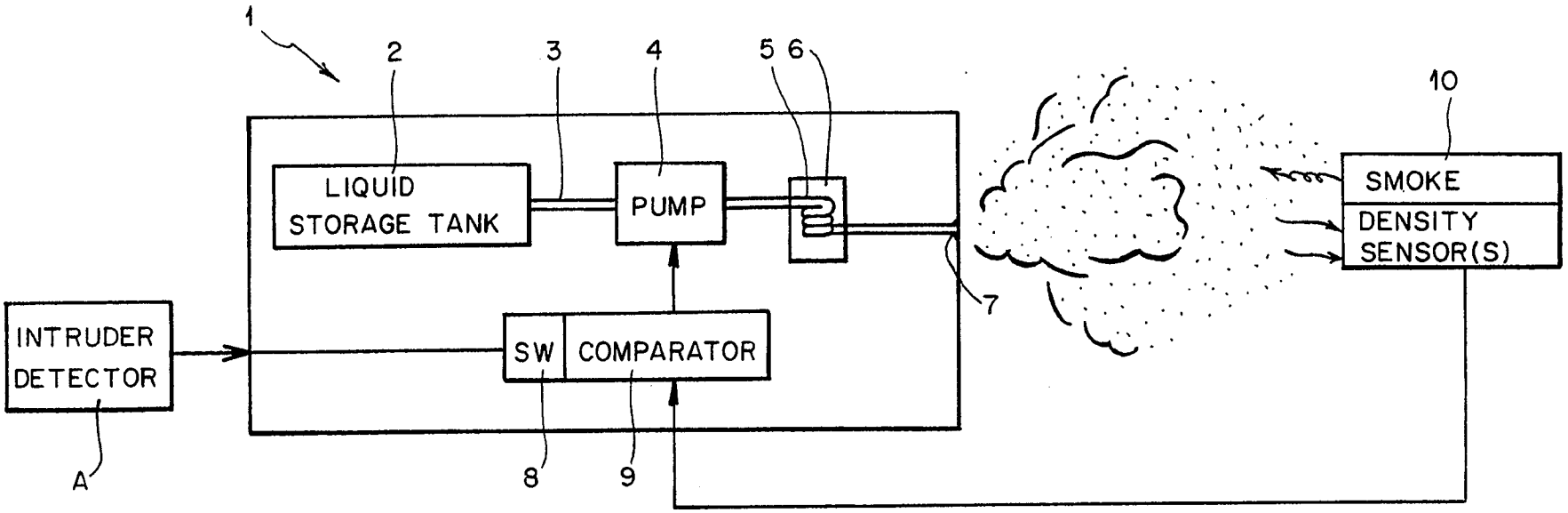
SMOKE
DENSITY
SENSOR(S)
10
7
6
5
PUMP
4
3
LIQUID
STORAGE TANK
2
1
COMPARATOR
9
SW
8
INTRUDER
DETECTOR
A

SMOKE SCREEN INTRUDER DETERRENT SYSTEM

This is a continuation of application Ser. No. 07/983,801, filed Nov. 30, 1992, now abandoned.

FIELD OF THE INVENTION

The present invention relates to an intruder deterrent system of the type which generates a smoke-screen, ie screen of smoke and/or vapour.

BACKGROUND OF THE INVENTION

Regardless of whether a country's economy is booming or is suffering from a recession, the one almost inevitable "growth industry" is crime against property. It is widely appreciated that nation wide burglary statistics show an almost unerring upward trend. Many companies and individuals have endeavoured to develop systems which will reduce the vulnerability of unguarded property. Sophisticated modern burglar alarms provide the most wide spread form of protection, serving to detect the presence of intruders and generate audible and/or visible warning signals normally both in the vicinity of the property and also at the neighbourhood police station. A severe limitation of the audible/visible alarm system is that the triggering of the alarm will not automatically deter a burglar and in most circumstances there will be a delay of as much as ten to fifteen minutes before the alarm is responded to by the owner, the police or other concerned citizens.

Others have recognised the inherent drawback of relying upon alarm systems alone and have designed devices which will impede or harm the burglar. Some of these systems would be regarded as inhumane and others are practically undesirable for the damage which they cause to the property or the inconvenience to the owner if accidentally triggered.

Of the more humane means for deterring or repelling intruders, smoke generating devices are amongst the most suitable for the purpose. French patent applications Nos FR-A-2558625 and FR-A-2538147 describe burglar detection and alarm systems which liberate noxious gasses such as tear gas or smoke to deter and/or hinder an intruder. Use of non-toxic smokes in anti-theft devices for protecting vehicles is disclosed in United Kingdom patent application No GB-A-2247094 and Netherlands patent application No NL-A-8402896.

Known types of smoke-generating intruder deterrent system are, however, invariably subject to significant problems. The existing systems have difficulty in generating a high density smoke screen. Secondly they have difficulty in maintaining that smoke screen, especially should the intruder take action to disperse the smoke by, for example, opening or breaking doors or windows to the smoke-filled room.

It is a general objective of the present invention to overcome these significant drawbacks of existing smoke-generating intruder deterrent systems.

SUMMARY OF THE INVENTION

According to a first aspect of the present invention there is provided an intruder deterrent system of the type which generates a smoke screen and which comprises: intruder detection means; smoke screen generating means; activating means operatively linked to the intruder detection means and the smoke screen generating means to activate the smoke screen generating means when the intruder detection means is triggered; and smoke screen density regulating means having a smoke screen density sensor to sense the density of the smoke screen and control means responsive to the sensed density to adjust the output of the smoke screen generating means to maintain the smoke screen density at a desired level.

The smoke screen generating means suitably comprises a pump the rate of operation of which is controllable by said control means to regulate the density of the smoke screen.

Advantageously the smoke screen generating means comprises a storage tank for an aqueous liquid composition and delivery pipes extending from the tank to deliver the liquid to an outlet, there being further provided heating means to heat the liquid which has left the tank to thereby convert the liquid into a dense vapour.

Suitably the liquid comprises a mixture of glycol and water. Heating of this mixture as it passes through the delivery pipes to the outlet will vaporise the mixture to form a fog.

Preferably the smoke density sensor is housed independently of the smoke screen generating means.

BRIEF DESCRIPTION OF THE DRAWINGS

A preferred embodiment of the present invention will now be more particularly described, by way of example, and with reference to the accompanying drawing which is a schematic representation of the inventive intruder deterrent system.

DESCRIPTION OF THE PREFERRED EMBODIMENT

Referring to FIG. 1, there is shown a smoke-generating intruder deterrent unit 1, comprising a robust metal or plastics casing housing a liquid storage tank 2 which is adapted to act as a reservoir for a glycol/water or other suitable heat labile fog-generating mixture. One or more delivery pipes 3 extend from the storage tank 2 to a powerful oscillating piston pump 4 which, when activated, operates to draw the liquid mixture from the tank 2 and pump it at a selectable variable rate. The fluid pumped by the piston pump 4 is forced through a narrow coiled tube 5 located within an insulated heating block 6, to be heated to a thermostatically controlled temperature and vaporised prior to being expelled from the unit 1 via an outlet 7.

Within the unit 1 there is mounted a switch 8 which receives an input from an external intruder detection system A of any suitable known type. Switch 8 which may, for example, comprise a latching relay serves to activate the pump 4 when the intruder detection system is triggered.

Although the intruder detection system is, in the illustrated embodiment, shown as being external to the unit 1, it may, if desired, be formed integrally with the unit 1 making the unit 1 a wholly self-contained system enabling the unit to be positioned in a wide range of locations. In such case, the sensor is suitably of an infrared or microwave transmitting and receiving nature. The unit 1 suitably also incorporates its own internal power supply which is suitably of a nature similar to that used as computer back-up power supply. For most practical purposes, however, an external mains electricity power supply is adequate.

The intruder detection system may be located externally to the room so as to activate the smoke-generating unit 1 when the intruder breaks the perimeter of the estate or building prior to entering the room in which the unit 1 is installed. By doing so the room will be effectively smoke-filled, preventing vision, even before the burglar enters that room.

Attainment and maintenance of a satisfactory level of smoke screen density is achieved through feed-back control of the rate of vapour production by the unit 1. A control and comparator circuit 9, which is suitably of analogue type, controls the rate at which the piston pump 4 pumps the liquid mixture from the tank 2 and hence controls the rate of vapour generation. The control and comparator 9 receives signals from one or more smoke screen density sensors 10, which are suitably of a type similar to those used in conventional fire safety smoke detectors employing infrared transmissions and utilising the Tyndle effect of light dispersion, and compares those signals with a desired threshold level of smoke density which is pre-programmed into the system. The control and comparator 9 is responsive to the sense density of the smoke screen and adjusts the output and generates a signal to adjust the output of the smoke screen generating means, namely, pump 4, to maintain the smoke screen density at a desired level, i.e., the rate of operation of pump 4 is controlled by the control and comparator 9 to regulate the density of the smoke screen.

The smoke sensors 10 are suitably independent of the unit 1 and operatively linked thereto by one or more electrical cables or, alternatively, are operatively linked thereto by wireless communication means. By provision of the sensors 10 independently of the unit 1 substantial flexibility in the arrangement of the system is obtained. Amongst other factors, the independent position ability of the sensors enables adjustment by that means of the sensitivity of the system to the smoke screen density.

A number of smoke-generating units may be interlinked and connected to one or more sensors at a range of locations to provide optimal coverage of an area to be enshrouded in the smoke screen. By trial and error a suitable configuration of the smoke-generating units 1 and the sensors 10 may be arrived at to ensure that no area of a room is vulnerable to dispersion of the smoke screen by opening of doors or windows or the like.

By using a glycol/water mixture or similar heat labile fog-forming liquid composition, a long-lasting dense fog may be produced with little or no residue being deposited on the exposed surfaces of the room, leaving the room practically untouched by smoke once it has been dispersed and the smoke being totally innocuous to occupants of the room. A smoke screen of this nature is ideal for the purpose in question.

I claim:

1. An intruder deterrent system of the type which generates a smoke screen and which comprises: intruder detection means; smoke screen generating means; activating means operatively linked to the intruder detection means and the smoke screen generating means to activate the smoke screen generating means when the intruder detection means triggered; and smoke screen density regulating means having a smoke screen density sensor to sense the density of the smoke screen and control means responsive to the sensed density to adjust the output of the smoke screen generating means to maintain the smoke screen density at a desired level.

2. A system as Claimed in claim 1, wherein the smoke screen generating means comprises a pump, the rate of operation of which is controllable by said control means to regulate the density of the smoke screen.

3. A system as Claimed in claim 1, wherein the smoke screen generating means comprises a storage tank for an aqueous liquid composition and one or more delivery pipes extending from the tank to deliver the liquid composition to an outlet, the system further comprising heating means adjacent the delivery pipe (s) to heat the liquid composition in the delivery pipe (s) to thereby convert the liquid composition into a dense vapour.

4. A system as Claimed in claim 3, wherein the aqueous liquid composition comprises a mixture of glycol and water.

5. A system as Claimed in claim 1, wherein the smoke screen density sensor is housed in a first housing and the smoke screen generating means is housed in another housing independent from said first housing.

6. A system as Claimed in claim 5, wherein the smoke screen density sensor and the smoke screen generating means are operatively linked by wireless communication means.

* * * * *